US005134931A

United States Patent [19]

Thompson et al.

[11] Patent Number: 5,134,931

[45] Date of Patent: Aug. 4, 1992

[54] CYLINDER PRESS FOR APPLYING FOIL TO PRINT STOCK

[75] Inventors: Edwin E. Thompson, Tigard; Gregory E. Jansen, Hillsboro, both of Oreg.

[73] Assignee: Liepelt & Son, Inc., Beaverton, Oreg.

[21] Appl. No.: 518,928

[22] Filed: May 4, 1990

[51] Int. Cl.[5] ..... B41F 3/18

[52] U.S. Cl. ..... 101/27; 101/281; 101/336; 400/234

[58] Field of Search ..... 101/27, 281, 336; 400/234

[56] References Cited

U.S. PATENT DOCUMENTS

| | | | |
|---|---|---|---|
| 3,244,092 | 4/1966 | Gottscho et al. | 101/336 X |
| 3,316,835 | 5/1967 | Liepelt . | |
| 3,728,962 | 4/1973 | Sherrington | 101/27 X |
| 4,118,264 | 10/1978 | Boettcher | 101/27 X |
| 4,627,343 | 12/1986 | Liepelt | 101/27 |
| 4,744,294 | 5/1988 | Liepelt | 101/27 |

*Primary Examiner*—Clifford D. Crowder

*Attorney, Agent, or Firm*—Robert L. Harrington

[57] ABSTRACT

A cylinder press converted to printing foil embossed images onto a printing stock. A supply roll of foil bearing ribbon is mounted forward on the reciprocating chase and the ribbon is extended over the chase through a pair of adjusting guide rollers to a stationary take-up mechanism. In the take-up mechanism, the ribbon is wrapped around a puller roller and onto a rewind roller. One of the guide rollers is stationary and the other reciprocates in a parallel path in at least half the speed of the reciprocating chase. The ribbon is wound in a serpentine configuration around the reciprocating guide roller forward to the stationary guide roller and back to the take-up mechanism to thereby retain a fixed pathway length regardless of the position of the chase. The ribbon is wrapped around the puller roller having a friction gripping surface for non-slip pulling of the ribbon. A stepping motor provides precise rotational control of the puller roller and a programmable computer is selectively programmed for the desired sequence of ribbon movement.

13 Claims, 4 Drawing Sheets

CYLINDER PRESS FOR APPLYING FOIL TO PRINT STOCK

FIELD OF THE INVENTION

This invention relates to the feeding of hot stamping foil through a cylinder press and more particularly to the take-up mechanism that controls the feeding operation.

BACKGROUND OF THE INVENTION

A cylinder printing press is well known. Very briefly, a cylinder is rotated on its axis. A portion of the cylindrical outer surface is adapted to sequentially receive and support a sheet of paper stock, carry the sheet through one rotation of the cylinder, and discharge the sheet prior to receiving a next sheet of paper stock.

A feed mechanism is synchronized with the cylinder rotation to sequentially feed the sheets to the paper receiving portion of the cylinder. Mounted below the cylinder is a sliding platform called a chase. The chase carries dies (formally type set used for printing). As the sheet of paper rotates to the bottom of the cylinder, the chase carries the dies into contact with the paper bearing portion of the cylinder and thus sandwiches the paper sheet between the cylinder and the dies carried by the chase. The linear speed of the chase and the peripheral speed of the cylinder are matched so that the sheet is simply rolled across the dies and the figures or designs of the dies are impressed onto the sheets.

As the sheet completes its pass around the cylinder bottom, the printing operation is completed. The section of the cylinder following the sheet bearing portion of the cylinder is relieved or inset to separate the cylindrical surface from the dies and as the cylinder completes its rotation so as to discharge the old and receive the new sheets, the chase is free to return to the start up position and is readied for printing the new sheet.

The present invention is directed to a converted use of the conventional cylinder printing press. In the prior printing press, the dies were provided with ink and in the printing operation, the designs carried by the dies were printed in ink on the paper stock. In the converted printing press, the dies are heated and hot stamping foil i.e. metal foil laminated onto a carrier film e.g. mylar is placed over the dies. (Hereafter the hot stamping foil is sometimes referred to as a foil bearing ribbon.) The heat from the dies is transferred from the configurations formed on the die to the foil which in turn is pressed onto the paper stock. The metal foil is transferred to the stock creating a metallic image of the die configuration e.g. in gold or silver. An explanation of the converted cylinder press is provided in the commonly assigned patents; U.S. Pat. No. 4,744,294, U.S. Pat. No. 4,627,343 and U.S. Pat. No. 3,316,835.

A problem that is experienced with the converted cylinder press concerns the feeding of the ribbon. The ribbon has to be indexed across the die after each printing operation to position an unused portion of the ribbon over each die figure. Because of the nature of the ribbon material, i.e. it flexes, the ribbon is pulled by a puller roller from a supply roll, the die being positioned between the rolls with the ribbon incrementally and controllably drawn across the dies by the action of the puller roller and its associated control mechanism.

Because of the nature of the control mechanism required for rewinding the used ribbon and for controlling the puller roller action, the various take-up mechanism including a used ribbon (foil) take-up or rewind roller, is mounted in a stationary cabinet at a position rearward from the path of the reciprocating chase and supply roll mounted on the chase. A translation mechanism adjusts the path of the ribbon as the space between the chase and take-up mechanism is varied so as to avoid loosening and tightening of the ribbon as the chase is reciprocated back and forth.

The take-up mechanism of the cylinder press previously available on the market could not adequately control the indexing of the ribbon. Large gaps were provided between the areas of foil transfer in order to avoid the undesired occurrence of overlapping. The foil that was wasted far exceeded 50% of the available foil on the ribbon. Furthermore, the limited number of sheets that could be "printed" per roll of ribbon meant more frequent servicing of the press, i.e. changing of the supply roll. Still further, the stress on the components of the take-up mechanism to attempt a reasonable utilization of the foil caused severe wear problems and undesired frequent repair.

BRIEF DESCRIPTION OF THE INVENTION

The mechanism for adjusting the path of the ribbon as provided in the prior converted cylinder press amounted to a folding rack (or scissor-like arms) whereby two sections of the rack were pivotally connected at abutting ends. The opposite ends of the two sections were connected, one to the reciprocating chase and the other to the stationary take-up mechanism. With the chase at the furthest point from the take-up mechanism, the two sections laid essentially in an end-to-end relationship along a straight reach. As the chase was moved toward the take-up mechanism, the sections were folded together in the shape of an inverted V. The ribbon or foil was threaded through spaced rollers provided on the sections. The ribbon thus followed a substantially constant path length (the length of the two sections) regardless of the relative position of the supply roll to the take-up mechanism. However, the rapid folding action of the two sections causes wear problems and although "substantially" constant, the path of the ribbon does not escape a slight variation in its length during reciprocation of the chase.

In the preferred embodiment, the ribbon is wound in a serpentine path around a pair of guide rollers, e.g. a top roller that is fixed and a bottom roller that reciprocates with the chase. The chase is supported on cylindrical bearings that roll back and forth on a support surface. The linear movement of the cylindrical bearings is half the movement of the chase. The bearings are coupled together and the bottom roller of the pair of guide rollers that form the serpentine path for the ribbon is carried by this coupling. As the chase moves back and forth, the bottom roller automatically moves closer to and further from the top roller at one-half the distance of the chase travel. Inversely the bottom roller moves farther from and closer to the supply roll at precisely the same rate, to exactly maintain the distance of the path between the supply roll and the stationary take-up mechanism.

The prior take-up mechanism included an indexing or puller roller and a pinch or press roller that pinched the ribbon against the indexing roller. Avoiding slipping of the ribbon was difficult due to the required pulling force for pulling the ribbon through the long pathway leading to the supply roll. Slipping of the ribbon relative to the puller roller was a common problem. Repeated and increased tightening of the press roller against the puller roller caused substantial stress and rapid wear and breakage of the take-up mechanism components. In the preferred embodiment of the present invention, the ribbon path through the take-up mechanism is generated so as to wrap the ribbon substantially around the periphery of the puller roller rather than simply passing the ribbon between the press roller and puller roller. The surface material of the puller roller is preferably elastomeric providing a soft gripping surface that grips the ribbon with a far greater surface-to-surface contact than the previous knurled puller rollers. The softer more extensive gripping area effectively prevents slipping of the ribbon relative to the roller which thereby precisely pulls the ribbon through the system. Little auxiliary pressure from a pinch or press roller is required. Whereas a press or pinch roller is preferably utilized, its primary function is to maintain a tight wrapping of the ribbon around the puller roller. Adjustment to the pressure applied by the press roller is not required and is considered a detriment. Thus, the adjustment has been eliminated.

A computer controlled stepping motor that functions independent of the motor for the take-up roller completes the components of the take-up mechanism. The independence of the rollers enables the development of multiple ribbon paths through the take-up mechanism with different driving rates applied to the multiple ribbons. The precision that is achieved by these modifications increases utilization of the cylinder press, dramatically reduces waste of foil, reduces wear and tear on the mechanism, and reduces down time due to supply roll replacement and repair.

DESCRIPTION OF THE DRAWINGS

With reference to FIG. 1, schematically illustrated is a cylinder press 10 including a rotating cylinder 12 (note arrow 16) with a sheet holding portion 14 on its periphery. Relative to portion 14, the remainder of the periphery of the cylinder 12 is recessed or relieved as illustrated.

Figure 1:
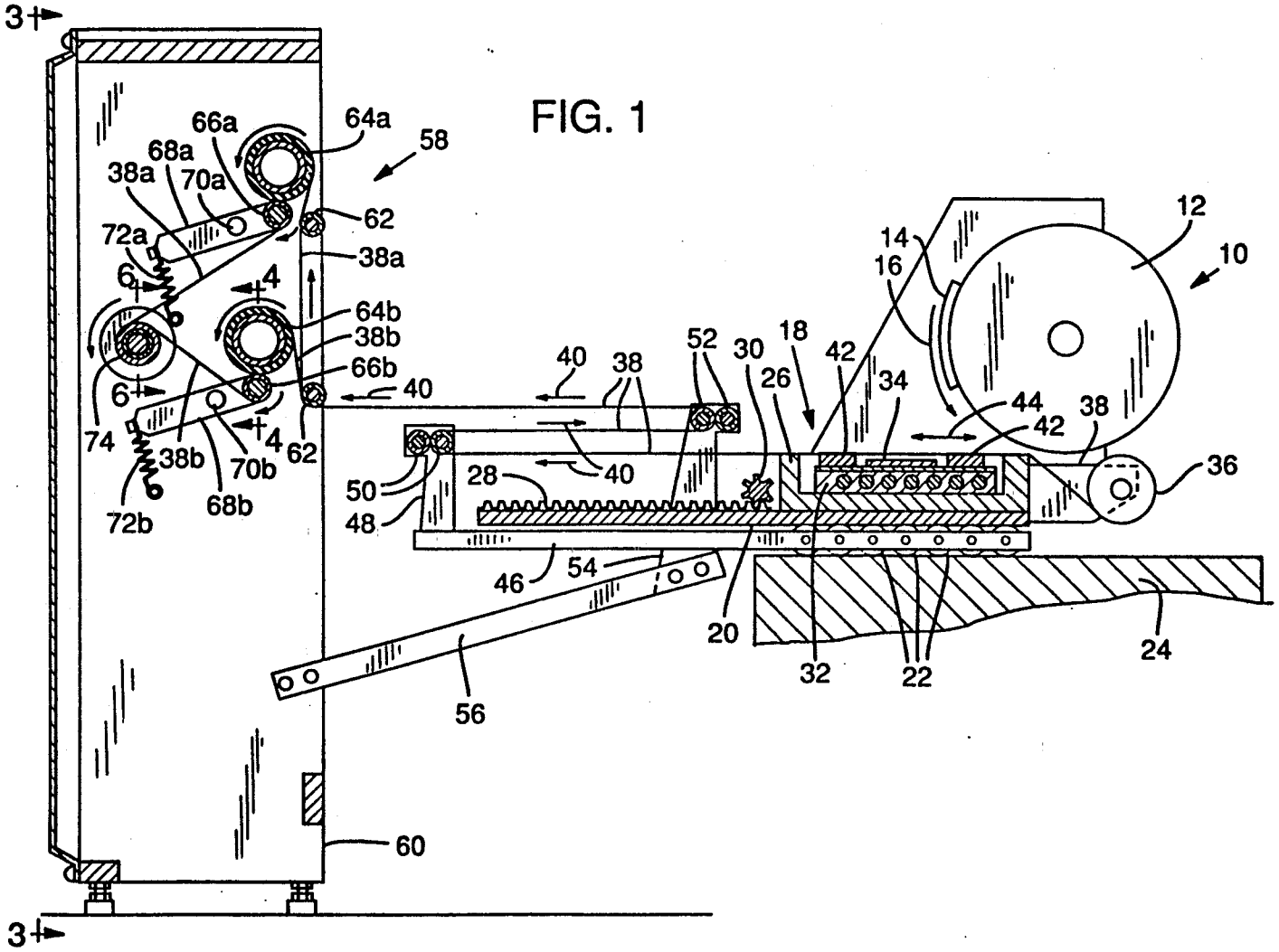
FIG. 1 is a schematic illustration, with portions shown in section, of a converted cylinder press incorporating the present invention.

Mounted beneath the cylinder 12 is a chase 18 including a carrier 26 that is mounted on a support plate 20. Support plate 20 is in turn supported on cylindrical rollers 22 that are adapted to roll on the flat top surface of base 24. The plate 20, as shown, extends rearward of the carrier 26 and gear teeth 28 provided on this extended portion meshes with gear teeth 30 of a sprocket to form a type of rack and pinion drive for the chase. (The drive motor not being shown in the figures.) The above arrangement of components is exemplary only as those skilled in the art are well aware of the mechanism for coordinating the operation of the cylinder and chase in a cylinder press.

Mounted to the carrier 26 is a platen 32 that is electrically, controllably heated and in turn heats a die 34 supported on the platen 32. A supply roll 36 of foil bearing ribbon 38 is mounted forward of the carrier 26 to be carried by the chase 18 as the chase 18 is rolled back and forth on rollers 22.

The ribbon 38 from the supply roll 36 is extended back over the carrier 26 and thus extends over the die 34 and along a pathway as indicated by arrows 40. The ribbon 38 is normally held away from the heated die 34 (when not pressed against the die by the cylinder) by insulated spacers 42.

In operation, the ribbon 38 has been indexed as will be subsequently explained, and the chase 18 is advanced toward the cylinder 12 as indicated by arrow head 44. This advance of the chase is synchronized with the rotation 16 of cylinder 12 so that sheet bearing portion 14 is pressed down onto the spacers 42 and die 34 as the chase passes under the cylinder 12. The peripheral speed of the cylinder 12 is matched to the linear speed of the chase 18 to effect the desired non-sliding contact of portion 14 relative to the die 34, the ribbon and paper sheet being sandwiched therebetween. This action transfers foil from ribbon 38 onto the paper in the image of the die 34.

The above operation and features of the cylinder press 10 are generally known and are explained in greater detail in the abovementioned commonly assigned patents. The departure therefrom relates to the take-up mechanism which will now be explained.

The rollers 22 are coupled together at their ends by bars 46 which extends rearward of the carrier 26. Brackets 48 are supported on the coupling bars 46 and the brackets 48 in turn support a pair of guide rollers 50. At a position forward and above idler roller 50 is a second pair of guide rollers 52 that is carried by brackets 54 which in turn are fixedly mounted to a stationary cabinet 60 by brace members 56.

The ribbon 38 as illustrated extends rearward from the carrier 26 to the guide rollers 50. The ribbon extends forward of guide rollers 50 to guide rollers 52, between rollers 52 and back to the take-up mechanism 58 contained in cabinet 60.

The length of ribbon that extends from the cabinet 60 to the supply roll 36 does not change but the distance between cabinet 60 and supply roll 36 does change as the change reciprocates. The difference is accommodated by the action of guide rollers 50 which will now be explained.

The coupling bars 46 reciprocate back and forth in relation to, but at half the rate of, movement of the chase 18. If chase 18 moves front to back a distance of thirty-six inches, rollers 50 move front to back a distance of eighteen inches. If rollers 50, at its rearward most position, is spaced rearward of rollers 52 at least eighteen inches, then the distance between rollers 50 and 52 varies by this same eighteen inches. When the distance between rollers 50 and 52 shortens or lengthens by an inch, the distance between the supply roll 36 and rollers 50 inversely increases or decreases by that same inch. The combined distance from supply roll 36 to rollers 50 to rollers 52 remains the same and accordingly the ribbon 38 remains taut throughout the reciprocation of the chase.

The take-up mechanism (except for the ribbon translation mechanism) is contained in a stationary cabinet 60. It needs to be first explained that whereas the description and explanation of the printing operation has been with reference to a single ribbon 38, it is very common that multiple rolls 36 of ribbon 38 will be positioned for side-by-side feeding of the ribbon through the apparatus. The mechanism up to the take-up mechanism is no different whether a single ribbon or multiple ribbons are being utilized. The side view of FIG. 1 up to the cabinet does not change for one or more ribbons. The ribbons are simply being spaced along the width, all following the identical serpentine path around the guide rollers 50, 52.

From rollers 52 the ribbons 38 are directed under roller 62 mounted on the cabinet 60. It is at this point that the different ribbons may be directed along different paths to different puller rolls. The different ribbons may or may not be fed at different rates through the press. The rate of feed, of course, depends on the amount of foil that is used up with each printing cycle. If different ribbons are to be fed through the press at the same rate, they can be controlled in the take-up mechanism by the same puller roll. When different feed rates are required, the ribbons need to be controlled by different puller rolls. As shown in FIG. 1, two such puller rollers are shown for controllably feeding two different ribbons. The two ribbons will be referred to as 38*a* and 38*b*.

With reference to FIG. 1, it will be noted that ribbon 38*a* passes under and around idler roller 62 and then to puller roll 64*a*. Ribbon 38*a* substantially encircles the puller roller 64*a* and then is directed around press roller 66*a*. Press roller 66*a* is mounted on an arm 68*a* that is pivoted at 70*a*. Tension spring 72*a* urges the press roller 66*a* against the puller roll 64*a*. However, the pressure exerted thereby is not great. The more important function of press roller 66*a* is to wrap the ribbon substantially around the puller roller 64*a* to maximize the surface-to-surface frictional gripping of the ribbon by the puller roller. Experience has shown that with the proper surface material, e.g. an elastomeric material of 70–90 durometer forming the outer surface on the puller roll, there is virtually no slipping of the ribbon on the roller surface in normal operation of the press.

Figure 5:
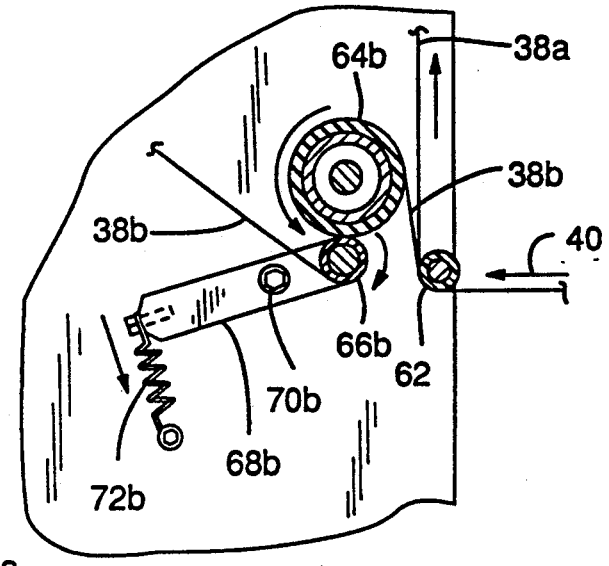
FIG. 5 is a view taken on view lines 5—5 of FIG. 4.

Ribbon 38*b* follows a similar path around puller roll 64*b* and press roll 66*b*. Both ribbons 38*a* and 38*b* are directed onto rewind roller 74. The pathway taken by ribbon 38*b* and the detail of the associated components are shown in the enlarged view of FIG. 5. It will be noted that no adjustment is provided for increasing the pressure of press roller 66*b* against puller roller 64*b*. Experience has shown that if slipping of the ribbon is occurring, it is because of some other failure, e.g. the take-up roller is failing to wind up the used ribbon and creating slack in the ribbon, or the ribbon is being hung up at the supply roll or in the chase, or the like. In such an event, to increase the pressure of the press roller would only magnify the problem as has proven to be the case in the prior apparatus.

Figure 4:
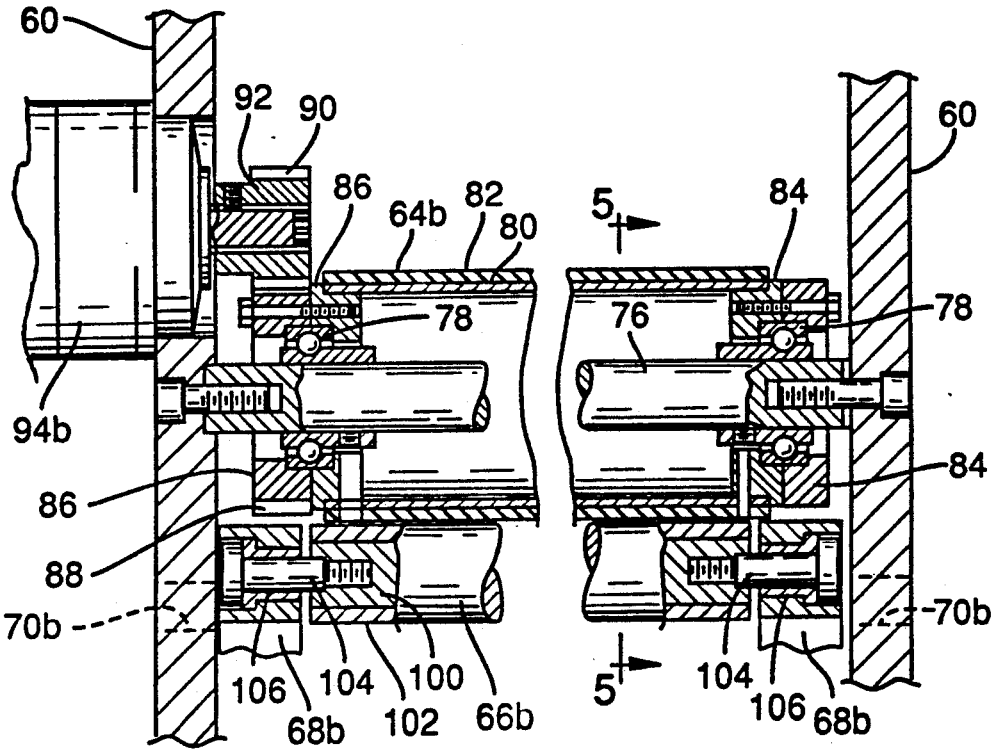
FIG. 4 is a section view of one of the puller rollers and associated mechanism as taken on view lines 4—4 of FIG. 1.

The puller rollers are illustrated in detail in FIG. 4. In this view, the puller roller 64*b* is shown from the position indicated by view lines 4—4 of FIG. 1. A support shaft 76 is mounted between the side rails of cabinet 60. Bearings 78 are mounted at each end of shaft 76 and the bearings 78 rotatably support end disks 84, 86 (which are each in two parts, bolted together to capture the bearings 78 therebetween) of tube 80 having elastomeric material 82 coated thereon. The outer half of end disk 86 is provided with splines 88. Splines 88 engage the splines 90 of output shaft 92 of a stepping motor 94*b*. Motor 94*b* is mounted to the side rail of cabinet 60.

Although not shown, it will be appreciated that the shaft 76 can support two rather than just one of the tubes 80. Two tubes 80, each less than half as long as that shown, positioned end to end on shaft 76 would be supported at their inner ends with disks 84 and bearings 78. A second disk 86 and the associated drive components including a stepping motor 94 could be provided on the other side rail (the right side as viewed in FIG. 4). Each tube would thus function as an independent puller roller.

Figure 2:
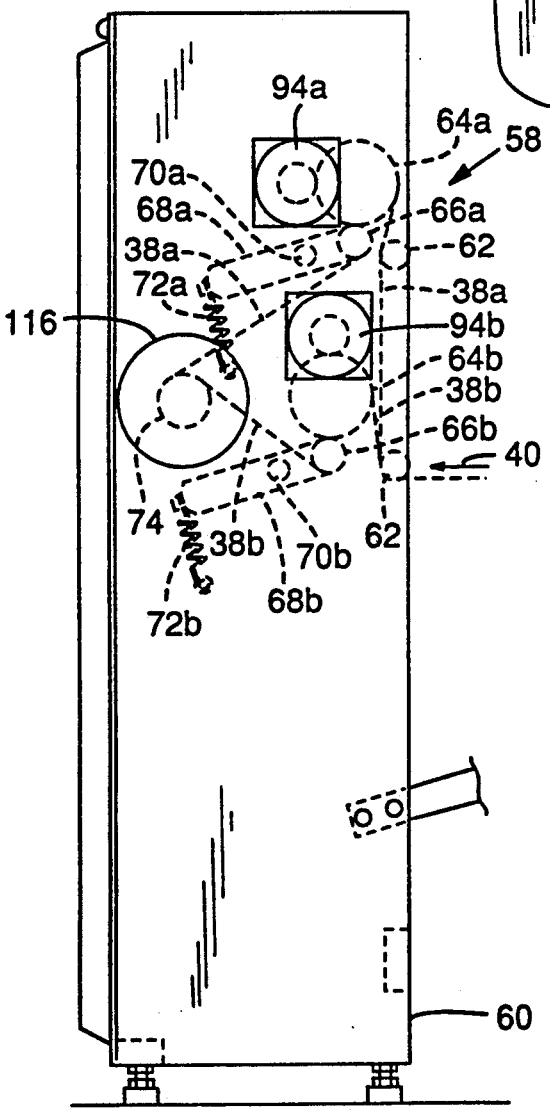
FIG. 2 is a side view of the take-up mechanism as taken on view lines 2—2 of FIG. 3.
Figure 3:
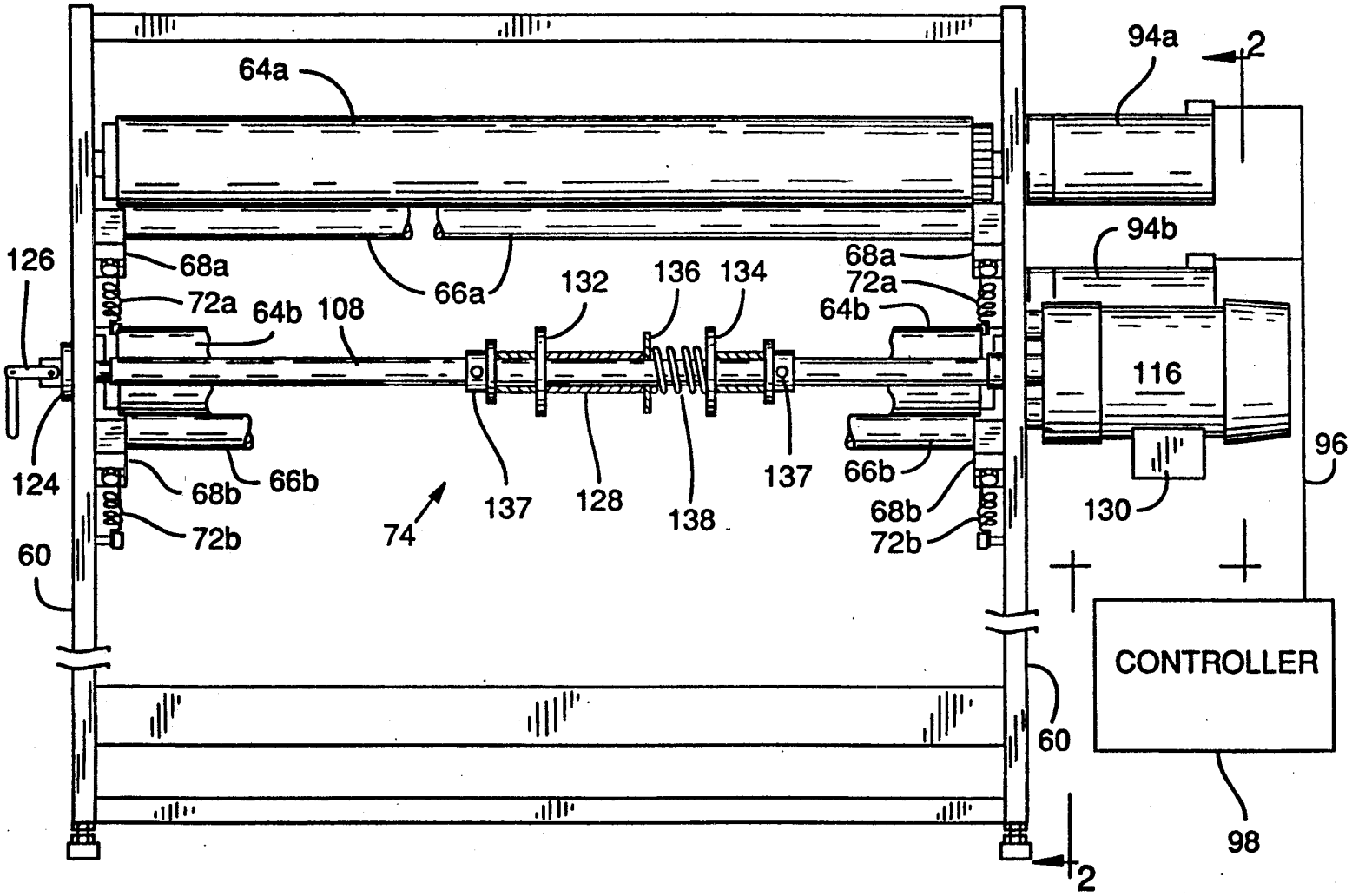
FIG. 3 is an end view of the take-up mechanism as taken on view lines 3—3 of FIG. 1.

FIG. 3 is a rear view of a cabinet 60 as indicated in view lines 3—3 of FIG. 1, and FIG. 2 is a view as taken on view lines 2—2 of FIG. 3. The position of the stepping motors 94 are accordingly reversed from that shown in FIG. 4. As illustrated in FIG. 3, the two motors 94*a*, 94*b* are connected through line 96 to a controller (computer) 98. With reference to FIG. 4, the press roll 66*b* includes a shaft 100 covered by an elastomeric material 102. The shaft is rotatably mounted through pins 104 and bearings 106 to the arms 68*b*. The mounting of the arms to the cabinet 60 is not shown in detail but dash lines indicate the position of pivot 70*b* in this figure.

Figure 6:
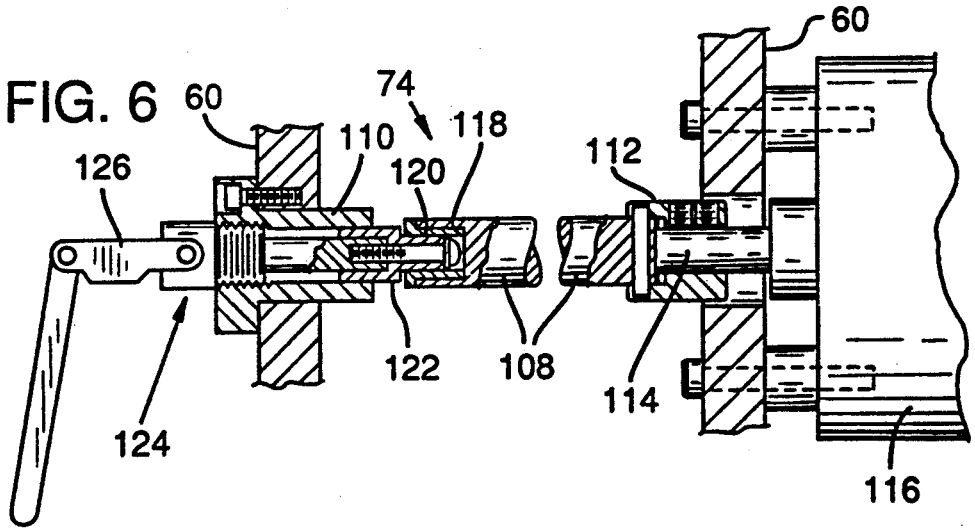
FIG. 6 is an enlarged illustration, partially in section, of the rewind roller support and mechanism illustrated in full view in FIG. 3.

The take-up roller 74 is illustrated in FIGS. 6 and 3, both being a view from the rear of the cabinet 60. The take-up roller 74 includes a sliding shaft 108. One end of shaft 108 slides in and out of coupling 112 that is fixed to the output shaft 114 of an electric motor 116, the motor 116 being mounted to cabinet 60 as shown. The other end has a bore 118 fitted with a bearing 120 that receives the shaft end 122 of a quick connect-disconnect bracket 124. The handle 126 of bracket 124 works an inner cam mechanism of common design to move the shaft end 122 back and forth. With the shaft end 122 moved back into the bracket, the shaft 108 can be withdrawn from coupling 112 and removed from shaft end 122 for changing the rewind rolls 128, an example of which is shown in FIG. 3.

During operation, the motor 116 runs continuously (panel 130 simply has an on/off switch). The rewind or take-up rolls 128 are loosely fit to shaft 108 but are sandwiched between two flanges 132, 136. Flange members 132, 134 are fixed on the shaft 108 by lock screws 137. Flange 136 is biased by spring 138 against the roll 128. Flanges 132, 136 rotate with the shaft 108 and urge rotation of rewind roll 128. Rewind roll 128 simply slips on the flanges 132, 136 until ribbon is pulled by the computer controlled puller roll 64 at which point the roll 128 rotates to wind up the released ribbon length. A separate rewind roll 128 is provided for each ribbon and they work independent of one another to accommodate the independent operation of the multiple puller rolls (e.g. 64*a*, 64*b*).

Operation

The operation of the apparatus will be fairly obvious from the above description. A number of supply rolls 36 are provided with ribbon 38. The ribbon is extended over the dies 34 on the chase 18, around the guide rollers 50, 52 and onto the stationary take-up mechanism. The operator determines for each ribbon the required length of foil needed for each printing cycle. As explained in U.S. Pat. No. 4,744,294, the required ribbon length may vary due to multiple transfers of foil that take place during a single cycle of the cylinder. Regardless, the sequence of ribbon movement that is required for each ribbon is input to the computer 98. Because of the precise control that is achieved with the take-up mechanism of this invention, the operator can space the projected transfer areas close together and thus provide for a minimum movement upon completion of each printing cycle.

The computer also maintains the temperature of the platen 32 and through control of a heating cable, maintains the desired temperature for effecting the transfer of the foil to the paper stock. The cable is not shown for clarity but in the apparatus as actually built, an electric junction box is mounted to a bracket 48 and a conductor extends forward to the platen 32. The cable is flexible and extends from the reciprocating junction box back to the cabinet 60 in a manner that allows flexing while minimizing undue bending or crimping thereof.

With the computer 98 programmed, the ribbons properly threaded and the platen heated to temperature, the cylinder press is set into motion. The chase is synchronized to slide under the cylinder and at the same rate of movement as the peripheral speed of the cylinder. As the paper stock carrier 14 approaches the underside of the cylinder, the paper stock is rolled against the die 34. The ribbon 38 is compressed between the images of the die e.g. as when raised from the die surface, and the paper stock. In the area of the images, the foil on the ribbon is heated and pressed against the paper to transfer the foil to the paper. As the paper stock lifts away from the die, the relief section of the cylinder periphery that follows the paper stock carrier 14, spaces the cylinder from the chase and die and the chase reverses direction to return it to the start-up position. The cylinder completes its cycle and starts into a new cycle and the process is repeated.

While the above is going on, the puller rolls 64 are non-rotating and the shaft 108 of take-up roll 74 simply spins inside the rewind rolls 128. The flanges 132, 136 continuously urge rotation and the length of ribbon through the process is thereby maintained taut.

The action of the guide rollers 50 was previously explained and is repeated. Because rollers 52 are stationary, there is no movement of ribbon up to rollers 52 during the printing operation. Rollers 50 move with the chase at half the speed of the chase. As the supply roll 36 increases its distance from rollers 50 (by half the distance moved by the chase) rollers 50 is moved toward rollers 52 by the exact same distance to thereby maintain the same combined distance and thereby hold the ribbon taut.

During the return stroke of the chase, the controller 98 initiates operation of the individual puller rolls, e.g. rollers **64*a* and 64*b*. The programmed amount of desired ribbon movement is converted to the required angular movement of the rollers. Because the ribbon is wrapped around the puller rolls at least half the roller's periphery and preferably substantially three-fourths of the periphery, a secure pulling force is imparted to the ribbon without the likelihood of the ribbon slipping on the roller surface. The desired amount of ribbon is thereby pulled off the supply roller 36 during the return movement of the chase (arrow head 44**) and an unused section of foil is positioned over the die images.

The above description as indicated relates to a preferred embodiment of the invention. Numerous variations are possible as will readily occur to those skilled in the art. The scope of the invention extends beyond this limited description as will be apparent by reference to the claims appended hereto.

We claim:

1. A cylinder press for applying foil images to print stock comprising:

a horizontally disposed printing cylinder, a paper stock holding section on the periphery of the cylinder, said cylinder rotatable about its axis for rotating the paper stock holding section, a chase slidably mounted along a path substantially tangential to the underside of the periphery of the cylinder, a carrier on said chase for carrying a heated die with designated images, said chase and cylinder being synchronized whereby paper stock on the cylinder is rotated into contact with the die of the die holder to transfer the images of the die to the paper stock, and the improvement that comprises, a ribbon supply roll holder at the front of the chase, a stationary take-up mechanism positioned rearward of the chase, and adjustable guide means for guiding the ribbon from the supply roll over the die on the carrier of the chase through a pair of spaced guide rollers carrying a length portion of the ribbon therebetween and to the take-up mechanism and for adjusting the path of the ribbon by adjusting the separation between said guide roller and by adjusting said length portion to maintain the overall length of the path during reciprocation of the chase, said take-up mechanism including a puller roller and a rewind roller, a controlled drive for said puller roller to selectively control the rotation of the puller roller, and a separate drive for the rewind roller for winding the used ribbon and to maintain the ribbon taut against the surface of the puller roller, the puller roller periphery having a friction gripping surface to avoid slipping of the ribbon whereby precise controlled rotation of the puller roller generates a similar precise pulling of the ribbon off the supply roll and over the die.

2. A cylinder press as defined in claim 1 wherein the path of the ribbon is directed around the puller roller to extend at least half the distance of the puller roller periphery and then to the take-up roll.

3. A cylinder press as defined in claim 2 wherein a first one of said pair of guide rollers is in a fixed position and a second one of said pair of guide rollers is movable in a path parallel to the movement of the chase, and said adjusting guide means further comprises means coupling said second guide roller to the chase for coordinated movement therewith at half the rate of movement of the chase, said second guide roller being positioned rearward of the first guide roller throughout its movement and the ribbon directed in a serpentine path rearward from the supply roller to the second guide roller, forward to the first guide roller, and rearward to the take-up mechanism whereby the length of the ribbon path from supply roll to the second guide roller to the first guide roller is a constant distance regardless of the position of the chase.

4. A cylinder press as defined in claim 3 wherein the chase is supported on bearing cylinders supported on a support base whereby the axes of the bearing cylinders reciprocate at half the rate of the reciprocating chase, said coupling means coupling the second guide roller to the bearing cylinders for reciprocating the second guide roller at the same rate as said bearing cylinder axes.

5. A cylinder press as defined in claim 2 wherein a movable press roller defines a portion of the ribbon path immediately following the puller roller to wrap the ribbon around the puller roller, said press roller biased against the puller roller to assist frictional gripping of the ribbon.

6. A cylinder press as defined in claim 5 wherein the rotation of the press roller is generated by a stepping motor for precise controlled rotation of the puller roller.

7. A cylinder press as defined in claim 6 wherein a programmable computer controls the stepping motor for controlled variable rotation of the puller roll as required for achieving the sequence of ribbon movement desired.

8. A cylinder press as defined in claim 7 wherein the wrap of the ribbon around the puller roller extends to at least half the roller's periphery.

9. A cylinder press as defined in claim 8 wherein a motor consistently turns the rewind roller to take up the used ribbon as released by the puller roller and to retain the ribbon taut continuously throughout the printing operation.

10. In a cylinder press having a printing cylinder and a reciprocating chase slidably mounted along a path tangential to the printing cylinder and adapted for applying foil to paper stock by provision of a die on said chase and positioning of foil ribbon intermediate of the die and paper stock carried by the printing cylinder, a foil advance mechanism comprising:

a stationary take-up mechanism positioned rearward of the chase and adapted to collect foil ribbon;

a ribbon supply roll mounted upon a front portion of the chase and adapted for dispensing foil ribbon rearward across the die and toward the take-up mechanism; and a guide roller assembly carrying said foil ribbon from said supply roll to said take-up mechanism and including at least two spaced apart guide rollers, one guide roller being coupled to the chase for variable separation between the guide rollers corresponding to reciprocation of the chase to vary a length portion of foil ribbon between said at least two guide rollers and maintain substantially constant the overall length of foil ribbon between said supply roll and said take-up mechanism.

11. The foil advance mechanism according to claim 10 wherein said at least two guide rollers comprises first and second guide rollers, the second guide roller moving reciprocally with said chase but as half its speed and the first guide roller being stationary with respect to said take-up mechanism, whereby said foil ribbon moves in serpentine fashion beginning at said supply roll, past said second guide roller, past said first guide roller, and to said take-up mechanism.

12. The foil advance mechanism according to claim 11 wherein said second guide roller is rearward of said first guide roller.

13. The foil advance mechanism according to claim 11 wherein said second guide roller is stationary with respect to a support base rotatably carrying bearing cylinders, the bearing cylinders resting upon a platform stationary with respect to the take-up mechanism and the chase being carried upon the bearing cylinders whereby the second guide roller reciprocates in the same direction but at half the speed of the chase.

* * * * *